US010113341B2

(12) United States Patent
Erices et al.

(10) Patent No.: US 10,113,341 B2
(45) Date of Patent: Oct. 30, 2018

(54) MOTOR VEHICLE LOCK WITH A POSITION SECURING SYSTEM

(71) Applicant: Kiekert Aktiengesellschaft, Heiligenhaus (DE)

(72) Inventors: Bernado Erices, Bergisch-Gladbach (DE); Madhu S. Basavarajappa, Dusseldorf (DE); Nicolas Cavalie, Le Port Marly (FR)

(73) Assignee: Kiekert Aktiengesellschaft, Heiligenhaus (DE)

( * ) Notice: Subject to any disclaimer, the term of this patent is extended or adjusted under 35 U.S.C. 154(b) by 406 days.

(21) Appl. No.: 14/901,755

(22) PCT Filed: Jul. 2, 2014

(86) PCT No.: PCT/DE2014/000333
§ 371 (c)(1),
(2) Date: Dec. 29, 2015

(87) PCT Pub. No.: WO2015/000458
PCT Pub. Date: Jan. 8, 2015

(65) Prior Publication Data

US 2016/0208524 A1 Jul. 21, 2016

(30) Foreign Application Priority Data

Jul. 2, 2013 (DE) ..... 10 2013 212 896

(51) Int. Cl.
*E05B 85/20* (2014.01)
*E05B 77/04* (2014.01)
(Continued)

(52) U.S. Cl.
CPC ..... *E05B 85/20* (2013.01); *E05B 15/0053* (2013.01); *E05B 77/04* (2013.01);
(Continued)

(58) Field of Classification Search
CPC ..... E05B 2015/0403; E05B 2015/0406; E05B 2015/0427; E05B 2015/0437;
(Continued)

(56) References Cited

U.S. PATENT DOCUMENTS 5,002,319 A * 3/1991 Chandler ..... E05C 19/063 292/17
5,079,964 A * 1/1992 Hamada ..... E05B 81/25 292/201
(Continued)

FOREIGN PATENT DOCUMENTS

DE 4108561 A1 9/1992
DE 10323888 A1 2/2004
(Continued)

OTHER PUBLICATIONS

Machine Translation of DE4108561A1 by Lexis Nexis Total Patent on Dec. 14, 2015.

*Primary Examiner* — Carlos Lugo
(74) *Attorney, Agent, or Firm* — Woodard, Emhardt, Moriarty, McNett & Henry LLP

(57) ABSTRACT

Disclosed are door locks that include a spring based position securing system for a locking or anti-theft device. The spring may be a dual-acting clamping spring. Also disclosed are methods for producing door locks that include the spring based position securing system.

14 Claims, 2 Drawing Sheets

(51) Int. Cl.
*E05B 15/00* (2006.01)
*E05B 15/04* (2006.01)

(52) U.S. Cl.
CPC . *E05B 2015/041* (2013.01); *E05B 2015/0403* (2013.01); *Y10S 292/61* (2013.01)

(58) Field of Classification Search
CPC ..... E05B 2015/0451; E05B 2015/0486; E05B 2015/041; E05B 15/0053; E05B 15/006; Y10S 292/61
USPC ..... 292/216, 219, 220
See application file for complete search history.

(56) References Cited

U.S. PATENT DOCUMENTS 5,257,838 A * 11/1993 Lin ..... E05B 63/06 292/1.5
5,938,253 A * 8/1999 Szablewski ..... E05B 81/14 292/201
6,575,507 B2 * 6/2003 Reddmann ..... E05B 81/14 292/201
6,607,224 B2 * 8/2003 Hodges ..... E05B 15/022 292/17
6,733,052 B2 * 5/2004 Perkins ..... E05B 81/06 267/153
6,948,745 B2 * 9/2005 Chevalier ..... E05B 81/14 292/201
7,377,557 B2 * 5/2008 Shelley ..... E05B 15/04 292/1
7,401,822 B2 7/2008 Graute
9,151,092 B2 * 10/2015 Scholz ..... E05B 85/26
9,752,357 B2 * 9/2017 Scholz ..... E05B 85/00
9,777,515 B2 * 10/2017 Barmscheidt ..... E05B 81/06
2004/0036298 A1 2/2004 Hayakawa et al.
2008/0078215 A1 4/2008 Odahara
2009/0229390 A1 * 9/2009 Ickenroth ..... E05B 83/30 74/110
2010/0077806 A1 4/2010 Yamagata
2014/0203572 A1 7/2014 Barmscheidt
2015/0048624 A1 * 2/2015 Bendel ..... E05B 79/08 292/85
2015/0084352 A1 * 3/2015 Barmscheidt ..... E05B 81/15 292/201
2016/0348405 A1 * 12/2016 Urmos ..... E05B 81/06

FOREIGN PATENT DOCUMENTS

DE 10320457 A1 12/2004
DE 102011018512 A1 10/2012
DE 102011076704 A1 * 12/2012 ..... E05B 85/26
EP 2330266 A1 6/2011
EP 2492423 A2 * 8/2012 ..... E05B 77/36
FR 1564650 A * 4/1969 ..... E05B 15/04
GB 2477612 A 8/2011
JP 2002132363 A * 5/2002 ..... E05B 15/0053
JP 4277441 B2 * 6/2009 ..... E05B 15/0053

* cited by examiner

MOTOR VEHICLE LOCK WITH A POSITION SECURING SYSTEM

BACKGROUND

The invention relates to a latch for a door or a flap comprising a locking mechanism that has a catch and a pawl for locking the catch. Such a latch is disclosed in DE 103 20 457 A1. The invention also relates to a method for producing a plurality of said latches.

The aforementioned latch serves for temporary locking of openings in motor vehicles or buildings with the aid of doors or flaps. In the closed state of such a latch, the catch extends around an, in particular, bow-shaped latch bolt, which in case of a motor vehicle is generally fixed to the car body. Where as a result of being pivoted with the aid of the latch bolt, the catch is moved from an open into a closed position, the catch is then locked by means of the pawl. A blocking face of the pawl then rests against a blocking face of the catch, preventing the catch from being turned back in the direction of the open position. When in the closed position, the latch bolt can no longer leave the locking mechanism.

To open the mechanism, the pawl must be moved out of its detent position. Once the pawl has been moved out of its detent position, the catch turns into the direction of its open position. In the opened position of the catch and thus in the opened position of the locking mechanism, the latch bolt can leave the latch. The door or flap can then be opened again.

After the pawl has moved out of its detent position, the catch can be turned in the direction of the open position by a sealing pressure of the respective door or flap or by a pretensioned spring. Such a rotation can also be caused by the latch bolt being pulled out of the locking mechanism.

In some latches, the catch has two different detent positions. In this case, the catch can then be first locked in a so-called pre-ratchet position and then in the so-called main ratchet position by continuing rotation in the closing direction. Although in the pre-ratchet position a latch bolt can no longer leave the locking mechanism, a respective door or flap is, however, not fully closed. Such a door or flap is only fully closed when the catch is turned up to the main ratchet position and is locked in this position.

The latch can contain a blocking lever able to block a pawl when the pawl locks the catch. In order to open such a locking mechanism, the blocking lever must first be moved out of its blocking position.

In order to facilitate particularly easy opening of a latch, the catch can introduce an opening moment into the pawl in the locked state. The opening moment can cause the pawl to be moved out of its detent position. In such a latch, unwanted moving of the blocking lever out of its detent position is prevented. If the blocking lever is moved out of its blocking position, the latch then opens automatically.

An actuating means is provided for opening the latch. Upon activating the actuating means the locking mechanism is opened. A handle of a door or of a flap can be part of the actuating means. This handle is generally connected to the actuating lever of the latch by means of rods or a Bowden cable. Upon actuating the handle, the rods or the Bowden cable pivot the actuating lever of the latch in such a way that the latch opens.

Latches of motor vehicles are regularly equipped with a central locking (see e.g. DE 4108561 A1) and/or an anti-theft device (see e.g. DE 10 2011 018 512 A1). To lock a side door latch and engage an anti-theft device, respective mechanisms are provided, generating a rotational or linear movement and thus locking or unlocking the latch or engaging or releasing the anti-theft device.

For safety reasons, any movement of the locking or anti-theft device should be prevented in the event of an accident, i.e. movement from a locked into an unlocked position or, in case of the anti-theft device, movement from an engaged into a released position.

In order to protect a locking means or anti-theft device against movement into another position during an accident or crash, an arrangement can be provided in which one leg of a spring has to me moved against the force of the spring in order to be able to move the position of a latch or antitheft device. The greater the force required for moving such a spring leg, the greater the required acceleration in the event of a crash in order to be able to change the position of an anti-theft device or of a locking mechanism. By using the correct spring force it can thus be achieved that accelerations of 30 g or up to 55 g cannot change the position of an anti-theft device or of a central locking. g stands for gravitational acceleration. The leg spring secures the position of a locking mechanism or the position of an anti-theft device in case of high accelerations, as experienced in the event of a crash.

The position of a locking mechanism or anti-theft device is regularly changed with the aid of a motor, when required. The existence of a position securing system requires a respective motor power to overcome the position securing system, i.e. to move the spring leg in the said example.

SUMMARY

The above characteristics can be individually or in any combination be part of the latch of the invention.

The invention aims to provide a latch with a correctly functioning position securing system.

The task of the invention is solved by a latch with the characteristics of the first claim. Advantageous embodiments are described in the dependent claims. An advantageous production method incorporates the characteristics of the subsidiary claim.

In order to solve this task the invention provides a latch comprising a locking mechanism that has a catch and a pawl for locking the catch. The latch includes a position securing system for a locking mechanism or an anti-theft device. A spring provides the position securing system. The spring is a double-direction pincer spring.

A spring is a double-direction pincer spring, if two legs of a spring have to be moved at the same time in order to be able to move the position of a locking mechanism or anti-theft device. In contrast to a one-direction spring, the inventive latch can advantageously move the locking mechanism or the anti-theft device with little force.

This is naturally subject to the fact that the respective position securing system can withstand the same acceleration forces.

Preferably, a stop is provided for the leg spring of the pincer spring, limiting the movement of the leg spring. This contributes to the fact that a relatively weak spring, i.e. a spring with a small spring constant can be used whilst still attaining a position securing system withstanding high accelerations of, for instance up to 30 g or up to 55 g.

One embodiment contains a pin, such as a cylindrical pin of the locking mechanism or of the anti-theft device on which the pincer spring acts on both sides in order to secure their position. The pin must be moved in order to change the position of the locking mechanism or of the anti-theft device. This can be a relative movement. Such a movement is counteracted by two legs of the pincer springs, which then rest against the pin. Such a movement of the pin causes the two legs of the pincer spring to be moved against the tension of the spring. This embodiment provides a position securing system requiring little installation space and little technical effort.

A spring in the context of the invention can also consist of two parts. It is only important that the spring contains two legs that have to be simultaneously moved against the force of the spring in order to unlock or lock a latch or to be able to move the position of an anti-theft device. Preferably the spring does, however, consist of a single part as this can minimize the technical effort required for production.

Movement of a leg in the context of the invention also occurs if not the entire leg but only a section of a leg is moved. A deformation of the leg is therefore also a leg movement in the context of the invention.

In one embodiment, the pin is linearly moved or can be linearly moved for changing a position of a locking mechanism or of an anti-theft device. This embodiment provides a particularly reliable functioning of the position securing system. In this way, a compact position securing system can be provided.

This contributes advantageously to be able to use a weakly dimensioned spring with a small spring constant to nevertheless provide a position securing system also able to withstand high accelerations.

In one embodiment, bodes ends of each leg are fixed. This advantageously contributes to using a weakly dimensioned spring whilst still providing a position securing system, also able to withstand high accelerations.

One embodiment includes a motor able to change the position of the locking mechanism or the position of the antitheft device. In contrast to arrangements in which a spring acting on a single side is used, a motor with a comparatively low power can be used. Consequently, a comparatively small and light-weight motor can be used. As a result, the overall required space and weight as well as the technical effort are kept to a minimum.

In order to produce the latch with little technical effort an in each case identical spring produces a plurality of position securing systems, preferably also fixed in an identical manner, so that the spring tensions always remain the same. In order to secure a position against different accelerations, as required, pins or cylindrical pins having different diameters and/or different cross sections will be used. With the same spring force acting on the pins and different diameters and differently shaped cross sections, different force characteristics are achieved. The forces to be met by a position securing system can thus be set, as required, by the selection of the pin, whilst the mechanism remains the same.

In order to produce position securing systems with an identical spring force that can nevertheless withstand different acceleration forces, pins with differently shaped cross sections can be used. Examples for such cross sections are triangular shapes, flattened circles or oval shapes. It is also possible to install pins, not having a circular cross section and which are differently aligned to each other in order to produce a position securing systems able to withstand different forces. Where, for instance, a pin with an oval cross section surface is used, the cross section surface is installed in such a way that the long extension of the oval runs parallel to the long extension of the legs, providing a position securing system, able to withstand relatively low acceleration forces. Where however, with the pin having the same design, the longitudinal extension of the oval is arranged transversely to the longitudinal extension of the legs of the spring, a position securing system is created that is able to withstand relatively large acceleration forces. Installing a pin not having a symmetrical circular cross section with a different alignment, as described, in order to be able to meet different acceleration forces, is equal to using pins with different diameters.

Below, the position securing system of a motor vehicle latch is explained in more detail with reference to one example, in which:

DETAILED DESCRIPTION OF THE DRAWINGS

Figure 1:
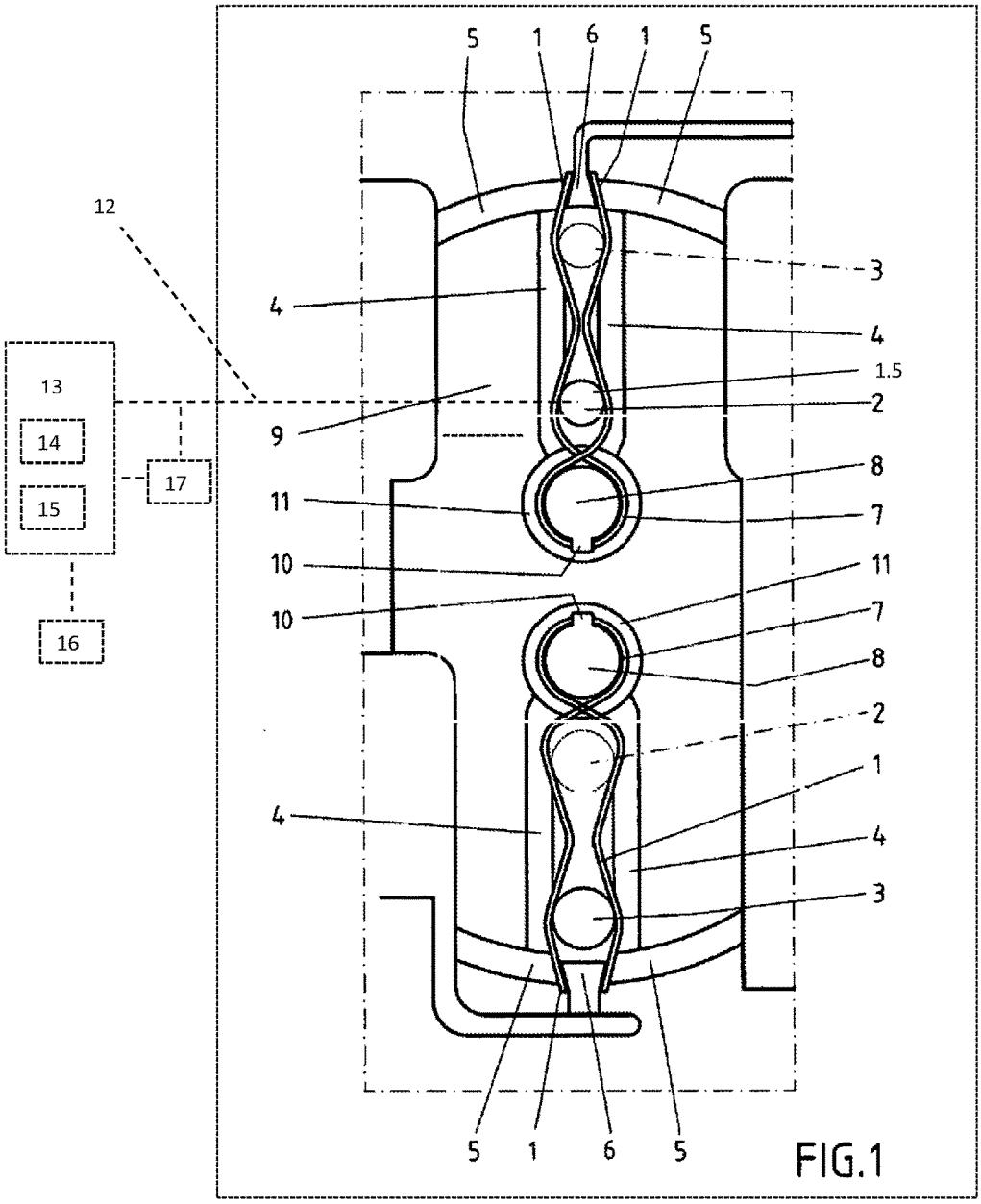
FIG. 1: shows two position securing systems.

FIG. 1 shows two pincer springs acting on both sides each with two wave-shaped spring legs 1. The wave shape of legs 1 creates two positions for one pin. The legs 1 of each spring clasp or surround a pin, for instance a cylindrical pin in its respective resting position 2 or 3. The pin can be linearly displaced to and fro between a point or position 2 and a point or position 3. In order to move from point 2 to a point 3 or vice versa, the legs 1 of a pincer spring, which in this case forms a single part, are pushed apart in a centre area between the two positions 2 and 3 and against the tension of the spring. A resting position 2, 3 of each pin is thus secured by the two legs 1 of a spring.

The movement of the legs 1 is externally limited by the walls 4 serving as a stop. They limit the movement of the legs 1, caused by the change of position of a pin from 2 to 3 or vice versa. In this way it is ensured that a pin is secured against a displacement when exposed to considerable acceleration without having to use excessively large dimensioned springs, i.e. springs with great spring constants. In each case, two walls 4 run parallel to each other and parallel to the longitudinal extension of the respective spring with the legs 1. Two walls 5 serve to fix or secure the free end of legs 1. A wall area 6 between the two legs 1 of a spring in the area of the free ends also serve to secure or fix the free ends of legs 1. In particular, the free ends of legs 1 are positively or non-positively held or fixed by walls 5 and 6.

The other end 7 of each single-part spring, opposing the free end of legs 1 extends circularly around a pin 8 of the housing 9. A web 10 laterally protruding from the pin 8 contributes to maintaining the end 7 of each spring in a positively fitting manner. The end 7 is also surrounded by a wall 11, also contributing to a positive retention of end 7 of each spring. The end 7 is thus also fixed.

As shown in FIG. 1, pin 1.5 is coupled to locking mechanism 13 by actuating lever 12. Locking mechanism 13 includes catch 14 and pawl 15. Motor 16 can optionally be included. Motor 16 is able to change the position of locking mechanism 13. Alternatively, pin 1.5 may be coupled to anti-theft device 17 by actuating lever 12. Locking mechanism 13 has a locked and unlocked state. Anti-theft device 17 has a locked and unlocked state. Moving pin 1.5 between positions 2 and 3 corresponds to moving locking mechanism 13 or anti-theft device 17 between locked and unlocked states.

Where a latch is unlocked by an actuating lever, a pin is, for instance, moved from position 2 to a position 3. The spring with legs 1 prevents such movement and an associated unlocking solely for the reason of a high acceleration, as can occur in the event of a crash.

FIG. 1 show a top position securing system and a bottom position securing system. The two position securing systems are mechanically identical with the exception of the pin. The pin of the top position securing system has a smaller diameter than the pin of the bottom position securing system. Due to the smaller diameter, the top position securing system can withstand lower acceleration forces than the bottom position securing system.

The pins shown in FIG. 1 have a circular diameter. The pins are cylindrical pins. Instead of a circular diameter, the diameter of a pin can, for instance, be triangular semi-circular or oval.

Figure 2:
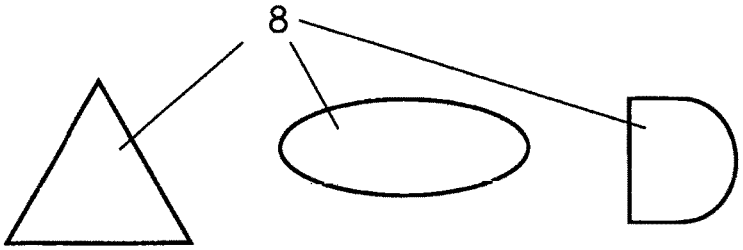
FIG. 2: shows examples for a position securing system.

FIG. 2 shows different cross sections of pins 9 that can be alternatively used in a position securing means. The figure shows a triangular cross section, an oval cross section and a flattened circular shape. Depending on the shape, the dimension and installation direction, the desired acceleration forces can be set in a position securing system and which can be withstood by a position securing system.

LIST OF REFERENCE NUMBERS

1: Leg of a pincer spring
1.5: Pin
2: Resting position of a pin
3: Resting position of a pin
4: Wall
5: Wall
6: Wall
7: End of spring
8: Housing pin
9: Pin cross sections for position securing system
10: Web
11: Wall
12: Actuating lever
13: Locking mechanism
14: Catch
15: Pawl
16: Motor
17: Anti-theft device

The invention claimed is:

1. A latch with a locking mechanism that includes a catch and a pawl for locking the catch and optionally including an anti-theft device, the latch comprising:

a position securing system comprising:

an actuating lever coupled to one of the locking mechanisms or the anti-theft device;

a pin movable between a first position where either the locking mechanism or anti-theft device is locked and a second position when either the locking mechanism or anti-theft device is unlocked, wherein the pin is coupled to the actuating lever;

a pincer spring with a first spring leg and a second spring leg that act on opposite sides of the pin, wherein the pincer spring resists moving the pin between the first and second positions; and a housing comprising a first wall and a second wall that act as stops which limit the movement of the first and second spring legs caused by moving the pin between the first and second positions, wherein the first leg spring has a first free end and the second leg spring has a second free end, wherein the free ends are fixed to the housing.

2. The latch according to claim 1, wherein the latch includes a motor adapted to change the position of the locking mechanism.

3. The latch according to claim 2, wherein the position securing system can secure a position of the pin from moving when exposed to acceleration forces of up to 55 g.

4. A system comprising two latches according to claim 1, wherein the pincer springs in each latch are identical for each position securing system and wherein a first pin of a first position securing system differs from a second pin from a second position securing system by its diameter and/or its cross section and/or its installation direction if the diameter is not circular.

5. A Method of producing a plurality of latches with a position securing system according to claim 1, wherein all latches with springs are produced with identically effective spring forces of the position securing system but not with identical pins for each position securing system.

6. The latch according to claim 1, wherein the latch includes a motor adapted to change the position of the locking mechanism.

7. The latch according to claim 1, wherein the position securing system can secure a position of the pin from moving when exposed to acceleration forces of up to 30 g.

8. The latch according to claim 1, wherein the position securing system can secure a position of the pin from moving when exposed to acceleration forces of up to 55 g.

9. The latch system according to claim 1, further comprising a third wall positioned between the first free end and the second free end, wherein the third wall secures the position of the first free end and the second free end.

10. The latch system according to claim 1, wherein the pincer spring defines a circular mounting portion, a first diverging portion, a first converging portion, a second diverging portion and a second converging portion, wherein the first position is between the first diverging portion and the first converging portion and the second position is between the second diverging portion and the second converging portion.

11. The latch system according to claim 10, further comprising a web that engages the circular mounting portion and secures the circular mounting portion in position relative to the position securing system.

12. The latch system according to claim 1, further comprising a web that engages the pincer spring and secures a portion of the pincer spring from moving relative to the position securing system.

13. The latch system according to claim 1, wherein the first wall and the second wall together define a channel through which the pin can move between the first and second positions, wherein the first and second walls block non-linear movement of the pin relative to the position securing system.

14. The latch system according to claim 1, wherein the first and second walls are parallel to each other and are parallel to a lengthwise extension of the pincer spring.

* * * * *